United States Patent [19]

Brogli

[11] Patent Number: 4,717,046

[45] Date of Patent: Jan. 5, 1988

[54] SQUEEZABLE CONTAINER PARTICULARLY FOR LIQUID MATERIALS

[76] Inventor: Werner F. Brogli, Im oberen Letten, CH-4202, Duggingen, Switzerland

[21] Appl. No.: 888,528

[22] Filed: Jul. 21, 1986

[30] Foreign Application Priority Data

Jul. 22, 1985 [DE] Fed. Rep. of Germany ..... 3526112

[51] Int. Cl.[4] ..... B65D 35/08

[52] U.S. Cl. ..... 222/107; 222/491; 222/541; 206/484

[58] Field of Search ..... 222/107, 206, 212, 215, 222/145, 420–421, 478, 480–481, 494, 541, 547, 564, 491; 229/7 R; 206/484, 604, 620, 628, 634

[56] References Cited

U.S. PATENT DOCUMENTS

| | | | |
|---|---|---|---|
| 1,661,564 | 3/1928 | Ebbesen | 222/107 X |
| 2,350,931 | 6/1944 | Salfisberg | 222/215 X |
| 2,517,027 | 8/1950 | Rado | 222/107 X |
| 2,707,581 | 5/1955 | Kaplan et al. | 222/494 X |
| 3,155,282 | 11/1964 | Leblanc | 222/541 X |
| 4,331,264 | 5/1982 | Staar | 222/94 |
| 4,491,245 | 1/1985 | Jamison | 222/107 |
| 4,592,493 | 6/1986 | Smith | 222/212 |

FOREIGN PATENT DOCUMENTS

| | | | |
|---|---|---|---|
| 3126671 | 3/1982 | Fed. Rep. of Germany . | |
| 3122237 | 1/1983 | Fed. Rep. of Germany | 206/605 |
| 3143671 | 5/1983 | Fed. Rep. of Germany . | |

*Primary Examiner*—Joseph J. Rolla
*Assistant Examiner*—Michael S. Huppert
*Attorney, Agent, or Firm*—Daniel H. Bobis

[57] ABSTRACT

A container which is formed from a generally stiff but flexible blank of coated carton material by means of inwardly bulging and shaping a center section of an initially flat blank and joining together and tightly connecting the opposite side edges and flanges of the side sections in such a manner that the superimposed flanges are not connected with each other at one location, thus forming coacting sidewalls for a discharge opening. The coacting sidewalls are separable from each other by liquid being squeezed by pressure on the exterior of the container whereby this opening discharges the liquid into a separable tongue which is closed before use and is torn off or cut to provide a dispensing outlet for the container. For a concentrated dispensing of a liquid from the container, the discharge opening is provided with a groove at least in one of its coacting sidewalls extending in the discharge direction, whereby this groove extends outwardly with respect to the inner surface of the coacting sidewall so that the groove defines at least one guide conduit extending into the discharge outlet and separable area of the tongue.

9 Claims, 5 Drawing Figures

SQUEEZABLE CONTAINER PARTICULARLY FOR LIQUID MATERIALS

BACKGROUND OF THE INVENTION

This invention relates generally to squeezable containers and more particularly to a squeezable container made from a single flat blank of stiff but flexible coated carton material so shaped that the flat blank when folded on itself bulges preferably inwardly at the center or bottom section thereof and at the opposite side sections so that the opposite side edges and flanges of the side sections can be joined to form a fluid tight connection, wherein at least at one location the superimposed side edges and flanges are further formed to provide a discharge opening with flat coacting interengaging walls which are separable from each other, when squeezing pressure is applied to the exterior of the side walls of the container. The discharge opening is formed in a tongue adaptable to form a dispensing outlet by tearing or cutting the same during use of the squeezable container.

Such containers are known from German Patent Application Nos. DE-OS 31 26 671 and DE-OS 31 43 671 wherein the latter corresponds to U.S. application Ser. No. 889,595, and are successful as multi-usable or disposable packages for relatively small quantities particularly of a paste like filling material. The containers have a tongue which can be torn or cut to form a dispensing outlet through which the contents of the container can be discharged in whole or in part by squeezing the exterior surfaces or sides of the squeezable container.

It has been found however that when such containers contain liquid to be dispensed, that on squeezing these containers at least two or more liquid streams are produced which not only have different lengths but more importantly present a problem in controlling the direction of the liquid streams issuing from the dispensing outlet. This is due to the width of the dispensing outlet for the discharge opening and the inability to control separation of the coacting inner surfaces of the sidewalls forming the dispensing outlet and also due to the relative irregular edges which are formed when the tongue is torn during the use of the squeezable container. As a result the user of such prior art container may be soiled due to the surprising length and/or unexpected direction of the stream of liquid being discharged onto a given target. In addition, liquid may be wasted because it does not find the target at which the liquid is being dispensed from the squeezable container.

The present invention seeks to provide a squeezable container of the aforementioned type wherein the simple and inexpensive manufacture of such containers as well as the simplicity of use are maintained but the squeezable container will provide a safe and reasonably uniform dispensing of the liquid to the point or target where the liquid is intended to go when pressure is exerted on the exterior sides of the squeezable container.

This is accomplished in the present invention by providing in the discharge opening a preformed bulge or groove at least on one of the inner faces of the coacting surfaces of the sidewalls which lie adjacent to the dispensing outlet. Such groove or grooves act as a conduit and a guide for the liquid being dispensed.

SUMMARY AND OBJECTS OF THE INVENTION

This construction acts to concentrate the liquid stream when the coacting sidewalls of the dispensing outlet for the container separate due to pressure exerted on the exterior walls of the squeezable container in that the liquid discharges along the conduit or guide instead of more or less between the tightly superimposed coacting inner surfaces of the sidewalls, thus enabling the user of the squeezable container to control the length and the direction of the liquid being dispensed from the squeezable container.

One particular advantageous modification of the invention will be to provide bulges or grooves opposite each other in each of the respective coating sidewalls of the dispensing outlet so as to provide an enlarged cross-sectional area for increasing the amount of liquid which can be discharged from the squeezable container.

The bulges or grooves which define the conduits or guides in the coacting sidewalls of the discharge opening may be disposed to extend in opposite directions from each other when viewed in cross section and such grooves are made during manufacture of the flat blank from which the squeezable container is formed.

The bulges or grooves extend generally at right angles with respect to the transverse separating edge of the dispensing outlet formed when the tongue is torn or cut and this is desirable because it results in a preferred direction for the liquid stream being discharged from the squeezable container. However, the bulges or guides can be so positioned as to form conduits or guides which are either parallel or oblique to the direction of the discharge opening. Further, by increasing the number of bulges or grooves on the coacting inner walls of the dispensing outlet, the guides or conduits for the liquid can be so made that the deformation of the dispensing outlet will be relatively small to provide a uniform small discharge quantity or conversely can be adjusted to provide a uniform large discharge quantity to enable rapid emptying of the squeezable container. The use of relatively large bulges or grooves for defining the guides or conduits will be advantageous for larger containers in accordance with the present invention.

In one embodiment of the present invention, to facilitate use of the squeezable container, the separable tongue is formed with means for aiding and abetting the tearing of the separable tongue to form the dispensing outlet. One form of tear-off assistance to the dispensing outlet or separable tongue is a groove which extends transversely thereof. That is, transversely to the groove or grooves which define the guides or conduits for the liquid being dispensed through the dispensing outlet for the squeezable container. However, this tear off groove causes a reduction in the cross sectional diameter of the dispensing orifice after the tongue is removed because the groove compresses the coacting side walls of the discharge outlet or separable tongue for the squeezable container. It has been found that this cross sectional area of the coacting side walls yields immediately under the force of the liquid being dispensed when pressure is applied to the external sides and ends of the squeezable container.

The groove to aid in the tearing off of the separable tongue however has advantages because after the tear-off section is removed, the dispensing outlet so formed will remain partially closed so that penetration of impurities is prevented. Thus, a squeezable container with such an improved tearing off section may be prepared for discharge but not immediately utilized.

A further embodiment of the invention for improved handling may consist of providing an enlarged separable tongue which is enlarged at a point remote from the dispensing opening and/or the side edges of flanges of the squeezable dispenser which will improve the grip which can be applied to the tongue and therefore make it easier to tear off the section of the discharge outlet or separable tongue to form the dispensing outlet. This construction will make it easier for persons to grip and tear off the discharge outlet or separable tongue who have hand or finger handicaps or are under unfavorable conditions, for example, an athlete while running whose fingers have become sweaty and who is under the stresses of racing. This is also illustrated and shown in more detail in co-pending Application for U.S. Letters Patent identified under Ser. No. 888,530 and filed as of even date herewith.

All of the individual or plurality of above described features and measures taken alone or in combination with each other result in an improved squeezable container from which liquid may be dispensed in a concentrated manner without danger of soiling the user or of wasting the contents of the container, wherein the improved squeezable container is inexpensive and easy to manufacture and equally easy to use for the dispensing of such liquid. The comfort of handling this container and its suitability for dispensing liquid is considerably increased by the preformed bulges or grooves which define the conduits or guides in the coacting sidewalls which communicate with the dispensing outlet. Such squeezable containers however are also adaptable for dispensing paste type fillings such as tooth paste and the like flowable materials.

The invention will now be illustrated by reference to a plurality of embodiments and described in detail in conjunction with the drawings in which:

DESCRIPTION OF PREFERRED EMBODIMENTS OF THE INVENTION

Figure 1:
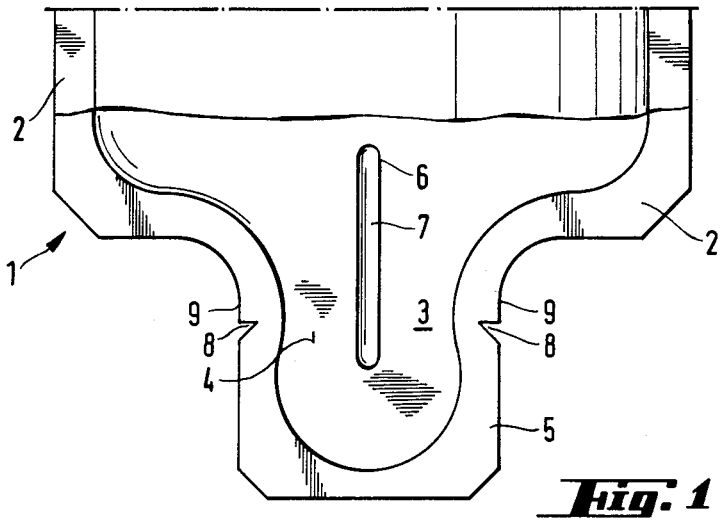
FIG. 1 is a side view of the discharge outlet end for a squeezable container in accordance with the present invention having a separable tongue and showing a single conduit or guide channel therein disposed in the longitudinal line of the discharge outlet.

Referring to the drawings FIGS. 1 to 4 illustrate various embodiments of the invention which show a squeezable container generally designated 1 in each of said embodiments. Only the respective discharge outlet ends of the respective embodiments which is remote from the bottom or center section of the squeezable container is shown.

Container 1 is formed from a single flat blank of coated carton material which is stiff but flexible and which can be formed by being folded on itself so as to provide a bulging and shaped bottom or center section, not shown, and also bulging and shaped side sections which are joined on the opposite edges and flanges as at 2 to form a fluid tight connection.

Figure 3:
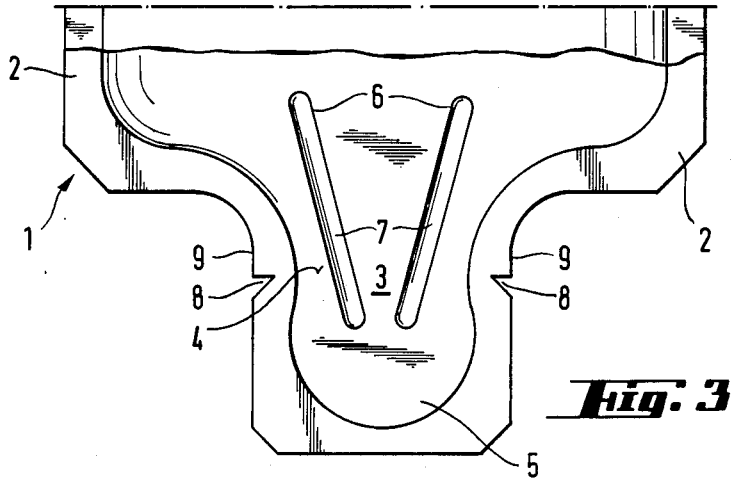
FIG. 3 is a side view of the discharge outlet for a squeezable container in accordance with the present invention showing two guides or conduits therein disposed obliquely to the longitudinal line of the discharge outlet.
Figure 4:
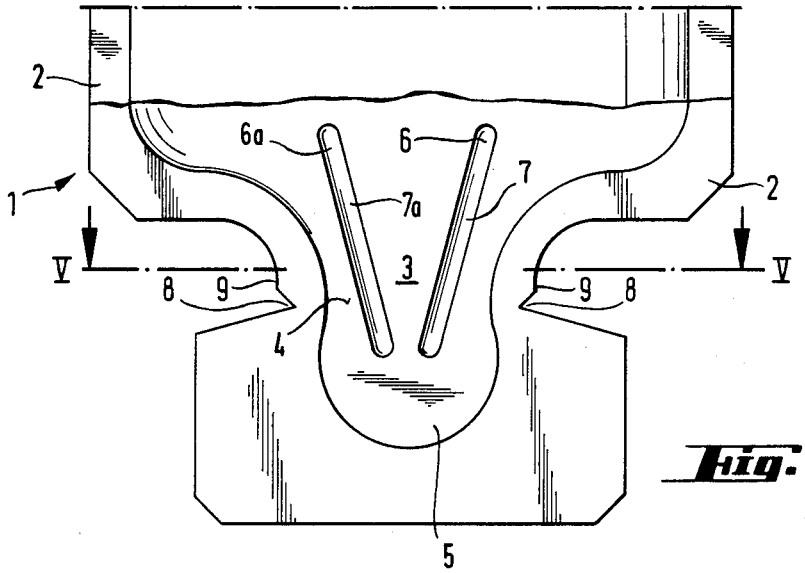
FIG. 4 is a side view of a discharge outlet for a squeezable container in accordance with the present invention showing at least two conduits or guide channels therein disposed oblique to the longitudinal line of the discharge outlet and showing the enlarged tongue to facilitate forming the dispensing outlet for the squeezable container.
Figure 5:
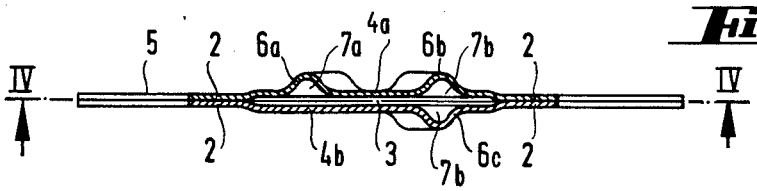
FIG. 5 is an enlarged cross section taken on line V—V of FIG. 4 which also serves to illustrate the same or similar cross section for respective FIGS. 1, 2 and 3 of the drawings.

The superimposed flanges 2 in accordance with the shape of the flat blank of coated carton material are so jointed that at least at one section they define a discharge outlet 3 when the superimposed flanges of the discharge blank are joined tightly together, as is shown in FIGS. 1, 2, 3 and 4 of the drawings and more particularly as illustrated in FIG. 5 so that in assembled position the walls as at 4*a* and 4*b* are spaced from each other to define the discharge outlet 3 therebetween.

As can be clearly seen in FIG. 5, the side edges or flanges 2 are joined and connected to each other so as to leave a space at least at one point thereby to form the discharge outlet 3 in the separable tongue area 5 all of which is shown in FIGS. 1 to 5 of the drawings.

When the tongue 5 is torn or cut a dispensing outlet will be formed which communicates with the dispensing outlet 3 in the cross sectional area formed by tearing or cutting of the separable tongue 5.

After the tongue 5 is torn or cut in order to concentrate and control the direction of the stream of liquid which will be dispensed through the dispensing outlet 3. The dispensing outlet 3 is provided with a preformed groove 6 in at least one of the limiting walls 4*a* or 4*b* which is disposed to extend with respect to the longitudinal line of the discharge opening 2 so that it defines a conduit or guide 7 which communicates with the discharge opening 2 adjacent to the dispensing outlet 3 which is formed when the separable tongue is torn or cut as above described.

FIG. 5 illustrates two of such bulges or grooves 6 which define conduits or guides 7 generally adjacent to each other in which the left conduit is formed by a single groove as at 6*a* in the limiting wall 4*a* which has a conduit or guide 7*a*. On the right side of FIG. 5 grooves 6*b* and 6*c* are formed in the respective walls 4*a* and 4*b* opposite each other to define a conduit or guide 7*b* therebetween illustrating that when the bulges or grooves are formed opposite each other in the respective opposite walls defining the discharge opening in the dispensing outlet that a corresponding larger cross sectional area is established for the conduit or guide channel formed between the respective bulges or grooves 6*b* and 6*c*. Thus, it is thought clear that the bulges or grooves 6 may advantageously be formed into the carton blank material from which the squeezable container is made before it is formed into the specific shape and design for the particular squeezable container.

These grooves 6 and the conduits or guides 7 formed thereby may extend generally normal or at right angles with respect to the point where the dispensing outlet 3 is formed as shown by the notches 8 on opposite sides of the separable tongue as respectively indicated in FIGS. 1 to 5 of the drawings.

Thus, the discharge opening for container 1 as shown in FIG. 1 illustrate a single straight groove 6 which forms a conduit or guide 7 for dispensing a single straight discharge stream of liquid from the squeezable container 1.

Figure 2:
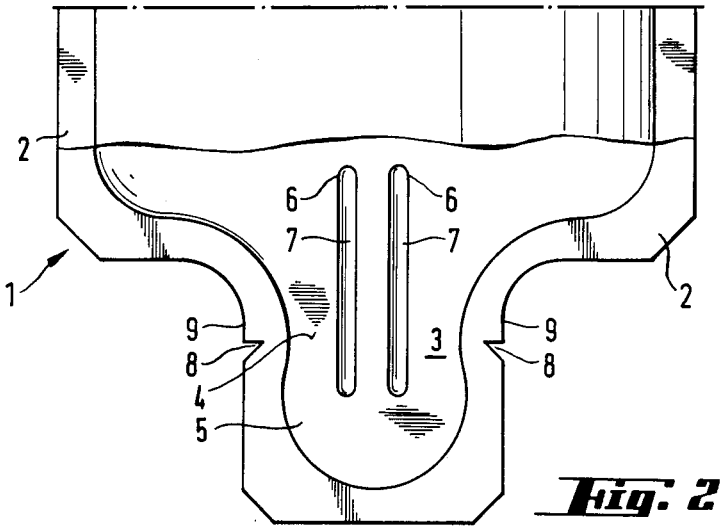
FIG. 2 is a side view of a discharge outlet end for a squeezable container in accordance with the present invention showing two conduits or guide channels therein disposed in the longitudinal line of the discharge outlet.

FIG. 2 illustrates an embodiment for providing two defined streams when pressure is exerted on the outside of the squeezable container 1 which may become a single stream depending on the degree of separation of the defined walls 4*a* and 4*b* for the dispensing outlet 3 of the squeezable container 1. In this form of the invention the grooves 6 are shown on opposite sides of the center-line for the squeezable container 1 generally parallel to the longitudinal line of the container 1.

Instead of two parallel extending conduits or guides 7, it is possible to establish converging or diverging guides or conduits 7 as is illustrated in FIGS. 3 and 4 of the drawings. In particular, converging grooves are a desirable arrangement to obtain better control of the direction of the stream of liquid being dispensed by the squeezable conduit 1 so that the stream can be aimed at a given target while at the same time it will provide means to increase the amount of liquid being discharged and reduce the cross sectional area required for the respective conduits or guides 7 in accordance with the present invention.

During use of the squeezable container 1, the limiting or coacting sidewalls 4*a* and 4*b* will be somewhat spread apart due to the squeezing pressure applied for forcing the liquid from the squeezable container. In effect, a somewhat conical stream of liquid is generated which permits and facilitates better dispensing and aiming of the liquid being discharged through the dispensing outlet 3 in communication with the discharge opening 2 for the container 1.

In all of the illustrated embodiments of the invention, it is important to know that the dispensing outlet 3 is disposed in a projection 9 of the assembled container 1. This projection is valuable because once the separable tongue is torn or cut to establish the dispensing outlet 3 for the container, it is possible to fit or connect the container into a small or tight opening or it permits the container to be used for dispensing liquid into the mouth of a person or patient. The projection enables the use of the container to concentrate the volume and direction of the liquid being dispensed into a given opening or position. This can be highly advantageous when the squeezable container is used as a disposable container for drinking during athletic competitions or for the taking of medicine. Further, when the content of the squeezable container is such that the material has to be transferred to a larger container which has a reduced or narrow opening, the protrusion or projection 9 aids along with the bulge or groove 6 in directing the liquid from the squeezable container into the larger container.

While preferred embodiments of the invention have been illustrated and described it will be understood that this is primarily to show the basic principles of the invention and that the structural details of squeezable containers in accordance with the present invention may be widely modified and changed within the scope of the appended claims.

What is claimed is:

1. Squeezable container, in particular for liquid filling goods, made from a single stiff, but flexible blank of coated carton material shaped by inwardly bulging or shaping of a center section of the initially flat blank, and by simultaneously raising and outwardly bulging two side sections, and superimposing and joining in tight connection of the opposite side edges and flanges of the side sections, whereby at least at one location the superimposed flanges form a discharge opening with limiting side walls separable from each other by the squeezing pressure exerted on the side sections, and ending in a separable tongue which is closed before use and which on separation defines a dispensing outlet characterized in that:

a. the discharge opening is provided with at least one preformed groove in at least one of the limiting side walls, and b. said preformed groove extends in the discharge direction of the container and defines at least one guiding conduit communicating with the dispensing outlet formed on the separable tongue to control the direction of and provide a uniform stream of the liquid being discharged.

2. Container in accordance with claim 1, characterized in that both of the sidewalls forming the discharge opening are provided with aligned grooves at locations facing from each other.

3. Container in accordance with claim 2, characterized in that the grooves extend outwardly in the limiting sidewalls in directions opposite from each other.

4. Container in accordance with claim 3, characterized in that the grooves defining the guiding conduit extend generally at a right angle with respect to the dispensing outlet.

5. Container in accordance with one of claims 1, 2, 3 or 4 characterized in that the separable tongue is integral with the container and includes, means forming a tear-off assistance.

6. Container in accordance with claim 5, characterized in that:

a. the means forming the tear off assistance extends transversely to the means defining the guide conduits in the discharge opening, and b. said tear off assistance means includes, spaced notches on opposite sides of the separable tongue.

7. Container in accordance with claim 5, characterized in that:

a. the separable tongue is enlarged at the discharge end of the discharge opening, b. the side edges and flanges are enlarged to provide an improved gripping means to facilitate tearing off a part of the separable tongue.

8. Container in accordance with claims 3, characterized in that a pair of grooves are provided on at least one side wall, said pair of grooves converging in the direction for discharging liquid from the container.

9. Container in accordance with claim 4, characterized in that a pair of grooves are provided on at least one side wall, said pair of grooves being parallel to one another.

* * * * *